US010547126B2

(12) United States Patent
Riku

(10) Patent No.: US 10,547,126 B2
(45) Date of Patent: Jan. 28, 2020

(54) ELECTRICAL CONNECTOR WITH A SEPARATE RELEASING OPERATION PORTION ATTACHED TO THE LOCK ARM MAIN BODY

(71) Applicant: Tyco Electronics Japan G.K., Kanagawa (JP)

(72) Inventor: Kazuya Riku, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/952,708

(22) Filed: Apr. 13, 2018

(65) Prior Publication Data

US 2018/0301823 A1 Oct. 18, 2018

(30) Foreign Application Priority Data

Apr. 14, 2017 (JP) ..... 2017-080811

(51) Int. Cl.

| | |
|---|---|
| ***H01R 4/48*** | (2006.01) |
| ***H01R 13/627*** | (2006.01) |
| ***H01R 13/50*** | (2006.01) |
| ***H01R 43/00*** | (2006.01) |
| *H01R 13/11* | (2006.01) |

(52) U.S. Cl.

CPC ..... *H01R 4/48* (2013.01); *H01R 13/50* (2013.01); *H01R 13/6273* (2013.01); *H01R 43/00* (2013.01); *H01R 13/112* (2013.01)

(58) Field of Classification Search

CPC ..... H01R 4/48; H01R 13/50; H01R 13/6273; H01R 43/00; H01R 13/112; H01R 13/6271; H01R 24/62

USPC ..... 439/367, 345, 352–354, 358, 344, 828, 439/829

See application file for complete search history.

(56) References Cited

U.S. PATENT DOCUMENTS 5,571,030 A * 11/1996 Gladd ..... H01R 13/4367 439/188
5,611,711 A * 3/1997 Okada ..... H01R 13/6592 439/607.08

(Continued)

FOREIGN PATENT DOCUMENTS

EP 1587178 A1 10/2005
JP 10-155212 A 6/1998

(Continued)

OTHER PUBLICATIONS

Abstract of JP2012515429, dated Jul. 5, 2012, 1 page.

(Continued)

*Primary Examiner* — Travis S Chambers
(74) *Attorney, Agent, or Firm* — Barley Snyder

(57) ABSTRACT

An electrical connector comprises a contact, an electric wire connection spring connecting an electric wire to the contact, and a housing. The housing includes a contact accommodating portion receiving the contact, a mechanism accommodating portion receiving the electric wire connection spring, and a lock arm supported on the contact accommodating portion in front of the mechanism accommodating portion and configured to catch a mating connector. The mechanism accommodating portion has a front opening disposed between a rear end portion of the lock arm and the electric wire connection spring.

17 Claims, 6 Drawing Sheets

(56) References Cited

U.S. PATENT DOCUMENTS

| | | | | |
|---|---|---|---|---|
| 5,860,837 | A | 1/1999 | Böck et al. | |
| 6,336,824 | B1 * | 1/2002 | Sorig | H01R 4/4836 439/395 |
| 7,374,447 | B2 * | 5/2008 | Matsumoto | H01R 13/518 439/344 |
| 8,043,097 | B2 | 10/2011 | Ngo et al. | |
| 8,851,920 | B2 * | 10/2014 | Wu | H01R 4/4827 439/441 |
| 2004/0152355 | A1 * | 8/2004 | Rudy | H01R 4/4836 439/438 |
| 2008/0020628 | A1 | 1/2008 | Kikuchi | |
| 2010/0267292 | A1 * | 10/2010 | Pueschner | H01R 4/4818 439/834 |
| 2015/0056832 | A1 | 2/2015 | Fransen et al. | |
| 2015/0147900 | A1 | 5/2015 | Zhang et al. | |
| 2015/0236433 | A1 * | 8/2015 | Kusuhara | H01R 4/2466 439/395 |

FOREIGN PATENT DOCUMENTS

| | | | |
|---|---|---|---|
| JP | 4412726 | B2 | 11/2009 |
| JP | 2012-515429 | A | 7/2012 |
| JP | 2015-523700 | A | 8/2015 |

OTHER PUBLICATIONS

Abstract of JP2015523700, dated Aug. 13, 2015, 2 pages.
Extended European Search Report, European Patent Application No. 18167307.0, dated Aug. 13, 2018, 8 pages.

* cited by examiner

ELECTRICAL CONNECTOR WITH A SEPARATE RELEASING OPERATION PORTION ATTACHED TO THE LOCK ARM MAIN BODY

CROSS-REFERENCE TO RELATED APPLICATION

This application claims the benefit of the filing date under 35 U.S.C. § 119(a)-(d) of Japanese Patent Application No. 2017-080811, filed on Apr. 14, 2017.

FIELD OF THE INVENTION

The present invention relates to an electrical connector and, more particularly, to a terminal block electrical connector.

BACKGROUND

A terminal device connected with an electric wire on-site, such as a drive control device or a distribution board of industrial machinery as disclosed in Japanese Patent No. H10-155212A, has a quick connection terminal block. The electric wire is directly connected to a contact of the quick connection terminal block without the use of a crimp terminal or the like. The terminal block of JP H10-155212A has a slot into which an end of a stripped electric wire is inserted and a spring member for connecting the end of the electric wire inserted into the slot to a contact. By pushing the end of the electric wire in the slot against an elastic force of the spring member, or inserting the end of the electric wire into the slot with the spring member elastically deformed by a tool for wire connection, the end of the electric wire is electrically connected to the contact and retained in the terminal block with the elastic force of the spring member. In another known terminal block, instead of the spring member, the terminal block has a movable member movable in an axial direction of a screw by tightening the screw to press the end of the electric wire to the contact.

An electrical connector disclosed in Japanese Patent No. 2015-523700A has a lock arm for catching a mating connector. In order to prevent the lock arm from being damaged, a protection wall is provided in the vicinity of the lock arm.

The terminal block of JP H10-155212A does not have a lock arm for catching a mating terminal mated to the terminal block. In JP H10-155212A, by contrast, because the terminal block equipped with the mechanism for directly connecting the electric wire requires a movable space allowing deformation of the spring member or displacement of the movable member, the terminal block is thicker in a direction of deformation of the spring member or displacement of the movable member than a terminal block using a crimp terminal. A mechanism accommodating portion of a housing for accommodating the direct wire connection mechanism protrudes in a direction of thickness with respect to a portion of the housing formed with a cavity for accommodating the contact.

If the terminal block with the direct wire connection mechanism had a lock arm for catching a mating terminal, the lock arm could be disposed on an opposite side in the direction of thickness of the housing where the direct wire connection mechanism is accommodated. The housing, however, would then bulge to both the sides in the direction of thickness and encompass a larger space.

Alternatively, in order to avoid an increase in the thickness of the housing, the lock arm could be disposed on the same side as the mechanism accommodating portion. If the lock arm is positioned in a dead space on the same side as the mechanical accommodating portion and in front of the mechanical accommodating portion, a direction of movement of a mold part for molding a back face side of the lock arm is set in a direction perpendicular to frontward and rearward directions in order to prevent the mold part from interfering with the mechanism accommodating portion. However, if the mold on the back face side of the lock arm moves in that direction, the protection wall cannot be molded in the vicinity of the lock arm. Therefore, if the lock arm and the protection wall are integrally molded with the housing of the quick connection type terminal block, the lock arm must be positioned on the opposite side in the direction of thickness to the mechanism accommodating portion. As described above, however, this leads to a terminal block with an undesirable overall thickness.

SUMMARY

An electrical connector comprises a contact, an electric wire connection spring connecting an electric wire to the contact, and a housing. The housing includes a contact accommodating portion receiving the contact, a mechanism accommodating portion receiving the electric wire connection spring, and a lock arm supported on the contact accommodating portion in front of the mechanism accommodating portion and configured to catch a mating connector. The mechanism accommodating portion has a front opening disposed between a rear end portion of the lock arm and the electric wire connection spring.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
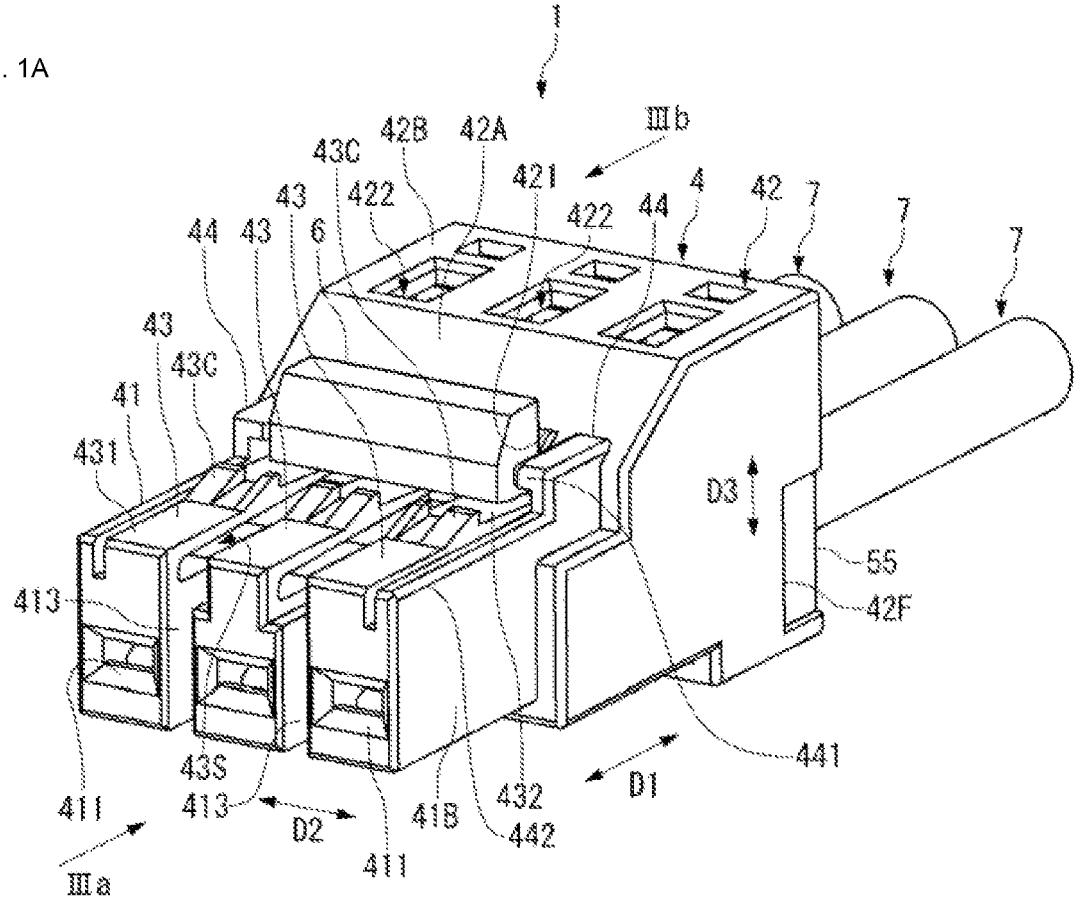
FIG. 1A is a perspective view of an electrical connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
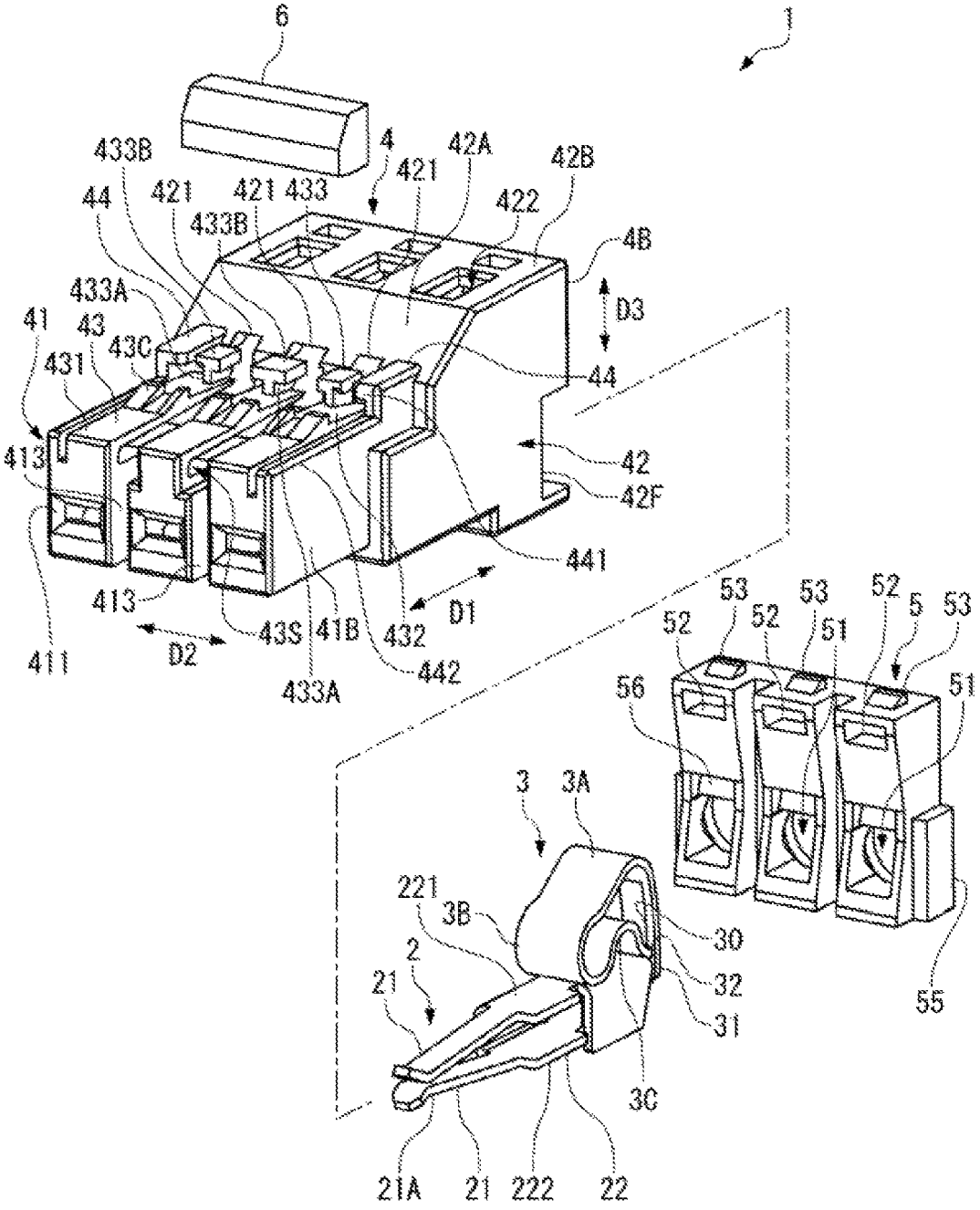
FIG. 2 is an exploded perspective view of the electrical connector of FIG. 1A.

A terminal block connector 1 according to an embodiment is shown in FIGS. 1A and 2. The terminal block connector 1 retains inside a housing 4 a plurality of female contacts 2 and a plurality of electric wire connection springs 3 for connecting electric wires 7 to those contacts 2. The terminal block connector 1 can connect one electric wire 7 directly to each contact 2 without using a crimp terminal or the like.

Figure 3B:
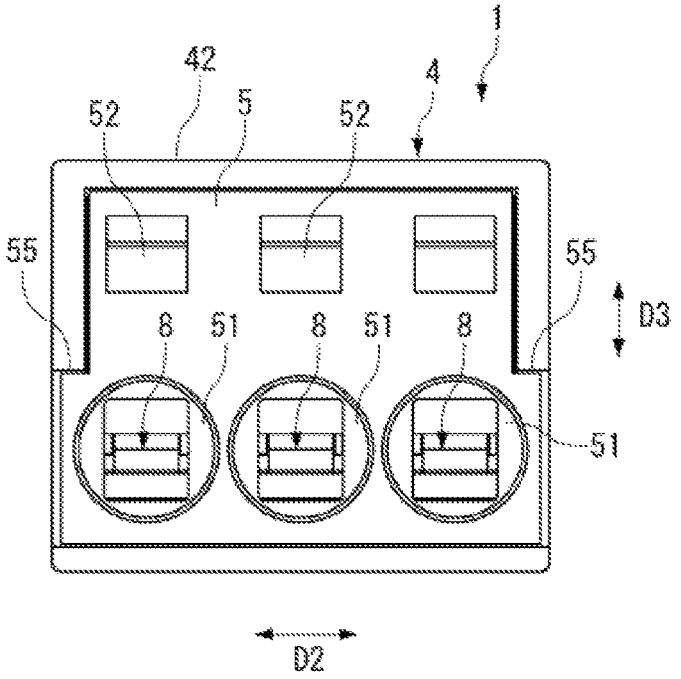
FIG. 3B is a rear view of the electrical connector of FIG. 1A.
Figure 4:
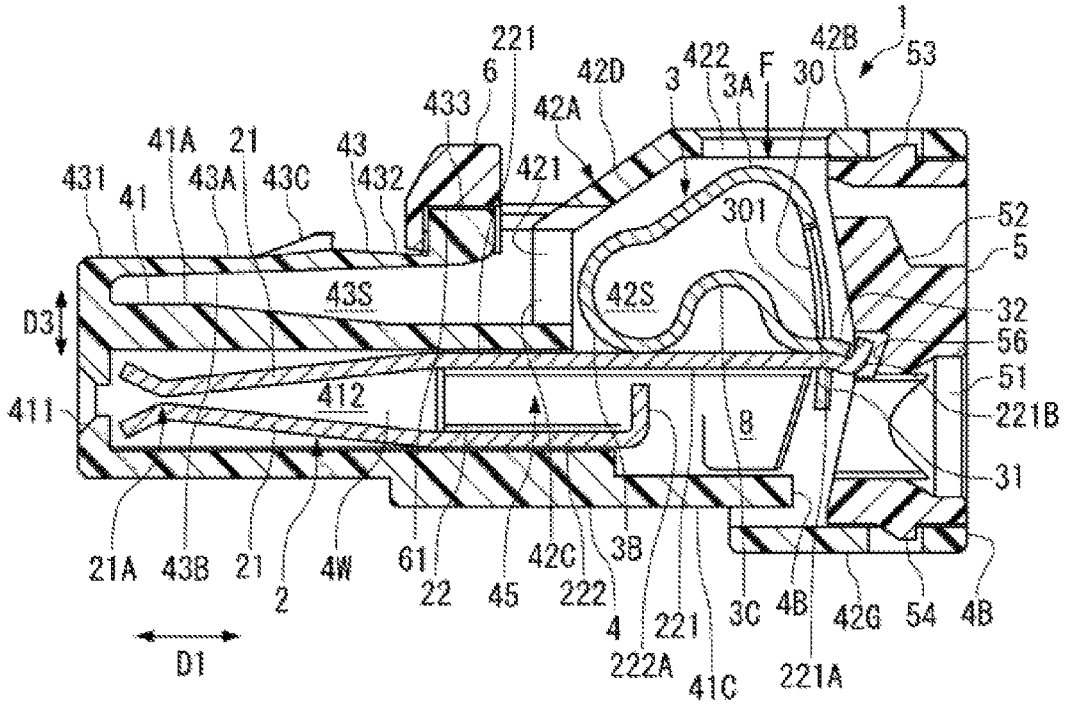
FIG. 4 is a sectional side view of the electrical connector taken along line IV-IV of FIG. 3A.

In the shown embodiment, the terminal block connector 1 is a multi-position connector. The terminal block connector 1 has a same number of slots 8, as shown in FIGS. 3B and 4, into which an end 7A of each electric wire 7 is inserted as the number of positions of the connector 1. The electric wire 7 is led out from the rear of the terminal block connector 1 through the slot 8. In FIG. 2, only one set of the contact 2 and the electric wire connection spring 3 is shown. The terminal block connector 1 however, has the same number of sets, three in the shown embodiment, of the contact 2 and the electric wire connection spring 3 as the number of positions.

The terminal block connector 1 is installed, for example, in a terminal device with which a machining tool or the like is provided. Such a terminal device is typically provided with multiple terminal block connectors 1. The multiple terminal block connectors 1 are so densely positioned that side faces adjoin each other.

A mating connector is mated with the terminal block connector 1 from a front of the terminal block connector 1 shown in FIG. 1A. A direction of plugging of the terminal block connector 1 with respect to the mating connector is defined as frontward/rearward direction D1 of the terminal block connector 1. In the frontward/rearward direction D1, a side of the terminal block connector 1 to be mated with the mating connector is defined as the front, and the opposite side is defined as the rear. A direction in which the plurality of contacts 2 are arranged side by side in a direction perpendicular to the frontward/rearward direction D1 is defined as widthwise direction D2 of the terminal block connector 1.

The terminal block connector 1, as shown in FIG. 2, includes the contacts 2, the electric wire connection springs 3, the housing 4 for accommodating the contacts 2 and the electric wire connection springs 3, a cover 5 attached to a rear end portion of the housing 4, and a releasing operation knob 6 for releasing the mating connector from a lock arm 43 formed in the housing 4. The slots 8 extending along the frontward/rearward direction D1 are formed frontward from electric wire insertion portions 51 of the cover 5 as shown in FIG. 4.

Figure 6A:
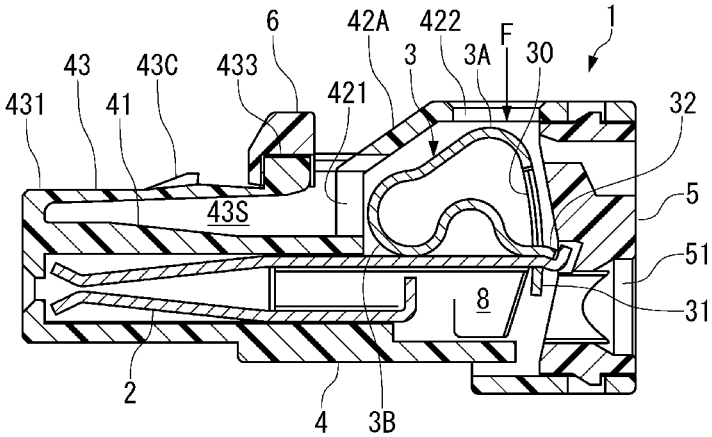
FIG. 6A is a sectional side view of the electrical connector with an electric wire connection spring in an undeformed position.
Figure 6B:
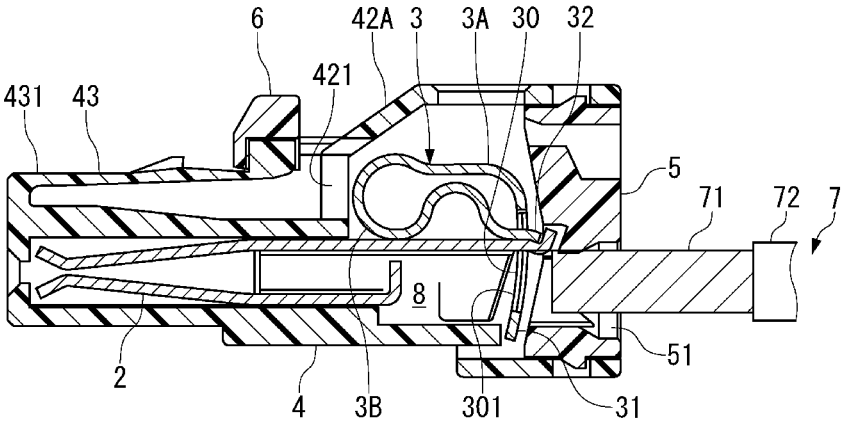
FIG. 6B is a sectional side view of the electrical connector with the electric wire connection spring in a deformed position and the electric wire before insertion into the electrical connector.

The electric wire connection spring 3 is pushed downward in a direction of arrow F from above in FIG. 4 by a tool for wire connection. The electric wire connection spring 3 thereby elastically deforms as shown in FIG. 6B. With this elastic deformation, a first end portion 31 of the electric wire connection spring 3 is displaced downward with respect to a second end portion 32 thereof. In another embodiment, the electric wire connection spring 3 may be a push-in type that does not require a tool or may be a member capable of moving in an axial direction of a screw.

Figure 1B:
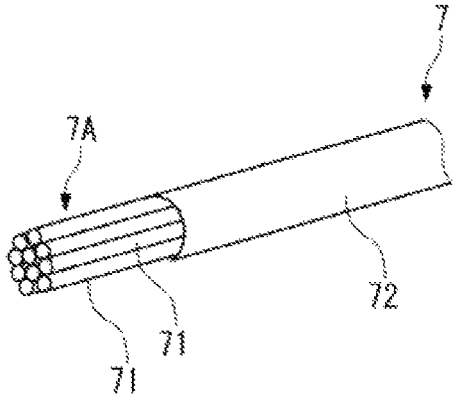
FIG. 1B is a perspective view of an electric wire.

The electric wire 7, as shown in FIG. 1B, has a core wire 71 formed from a metal material having good conductivity and a sheath 72 covering and thus insulating the core wire 7. An electric wire end 7A of the core wire 71 exposed from the sheath 72 is connected to the terminal block connector 1. The electric wire 7 shown in FIG. 1B has a plurality of core wires 71 composed of stranded wires. In another embodiment, the electric wire 7 may have a single core wire. The electric wires 7 are connected to the plurality of contacts 2 individually in the shown embodiment. However, in other embodiments, one wire 7 may be connected to a plurality of contacts 2, or a plurality of electric wires 7 may be connected to one contact 2. In an embodiment, a cylindrical member (ferrule) may be attached to the core wires 71 at the electric wire ends 7A.

Figure 6C:
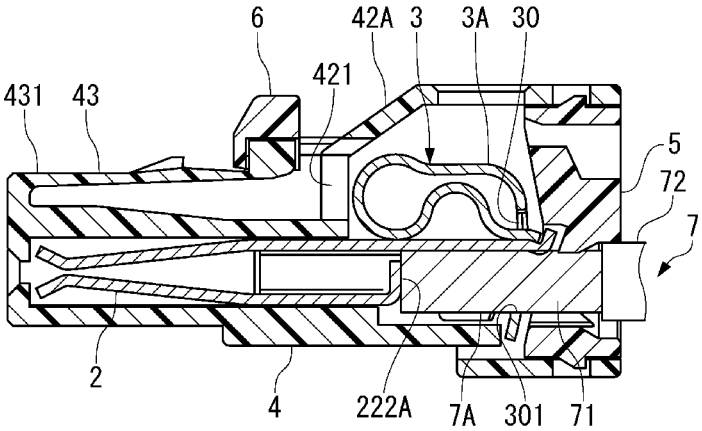
FIG. 6C is a sectional side view of the electrical wire connector with the electric wire connection spring connected to the electric wire.

The contact 2, shown in FIGS. 2 and 4, is formed by stamping and/or bending from a plate material made of a metal having elasticity and conductivity. The contact 2 has a pair of contact arms 21, 21 and a proximal end portion 22 extending into rear sides of the contact arms 21, 21. When a tabular male contact of the mating connector is inserted between the contact arms 21, 21, the contact 2 and the mating contact establish electrical continuity at a contact portion 21A. The slot 8, as shown in FIG. 4, is defined by an upper wall 221 of the proximal end portion 22 located in front of the electric wire insertion portion 51, an upright rear end portion 222A of a lower wall 222 of the proximal end portion 22, and a lower wall 41C of the housing 4. As shown in FIG. 6C, a distal end of the electric wire end 7A abuts against the rear end portion 222A, and thereby the electric wire end 7A is positioned with respect to the housing 4.

The electric wire connection spring 3, shown in FIGS. 2 and 4, exerts as elastic force to press the electric wire 7 to the contact 2 and retain the electric wire end 7A. The electric wire connection spring 3 connects the electric wire 7 to each contact 2 individually. The electric wire connection spring 3 of the present embodiment is formed by stamping and/or bending from a plate material made of a metal having elasticity and conductivity, as in the case of the contact 2.

The terminal block connector 1 has the same number of electric wire connection springs 3 as the contacts 2, and the electric wire connection springs 3 correspond to the plurality of contacts 2 individually. In other embodiments, one electric wire connection spring 3 may correspond to a plurality of contacts 2, or a plurality of electric wire connection springs 3 may correspond to one contact 2.

FIGS. 2 and 4 show the electric wire connection spring 3 in an unloaded state. The electric wire connection spring 3 is curved on the whole from the first end portion 31 to the second end portion 32.

With the elastic deformation of the electric wire connection spring 3, a window 30 formed in the electric wire connection spring 3 is displaced toward the inside of the slot 8, as shown in FIG. 6B. The window 30 constitutes a part of the slot 8 in the deformed position. The window 30 has a rectangular shape extending through the electric wire connection spring 3 in a direction of plate thickness over a predetermined range in the vicinity of the first end portion 31.

As shown in FIG. 4, between the window 30 and the second end portion 32, the electric wire connection spring 3 has a zone 3A curving frontward from a portion in which the window 30 is formed, a zone 3B located in front of and at the farthest distance from the window 30, and a zone 3C extending into the zone 3B and depressed toward an inner periphery of the electric wire connection spring 3. The zone 3B is formed in a circular-arc-like shape. The second end portion 32 is inserted into the window 30, and thereby the electric wire connection spring 3 has a closed shape. In an embodiment, the zone 3C is straight. As shown in FIG. 6B, the electric wire connection spring 3 elastically deforms from the unloaded state shown in FIG. 6A until the zone 3B takes a substantially circular shape by the zone 3A being pressed downward.

The electric wire connection spring 3, as shown in FIG. 4, is positioned on a surface of the upper wall 221 of the proximal end portion 22 of the contact 2. A rear end portion 221A of the upper wall 221 is inserted into the window 30 together with the second end portion 32. When the electric wire connection spring 3 is in the unloaded state shown in FIG. 6A, the rear end portion 221A of the contact 2 is sandwiched between a lower edge 301 of the window 30 and the second end portion 32.

When the elastic force of the electric wire connection spring 3 causes the window 30 to return upward with the electric wire end 7A passing through the window 30, as shown in FIG. 6C, an area in an opening region of the window 30 that communicates with the slot 8 is narrowed with respect to an outer diameter of the electric wire end 7A. Accordingly, the electric wire end 7A pressed upward with the lower edge 301 such that the lower edge 301 of the window 30 bites into the end 7A is connected with a predetermined contact pressure to a backside of the upper wall 221 of the contact 2 and restrained inside the window 30. In other embodiments, the electric wire connection spring 3 can be configured to have any size and shape suitable for achieving the quantity of displacement of the window 30 to allow the electric wire end 7A to pass through the window 30, as shown in FIG. 6B, and for achieving a retaining force for restraining the electric wire end 7A, as shown in FIG. 6C.

The housing 4, as shown in FIGS. 1A, 2, and 4, accommodates therein the contacts 2 and electric wire connection springs 3. The housing 4 is integrally formed in a single piece by injection molding using an insulation resin material in a mold.

The housing 4, as shown in FIGS. 1A, 2, and 4, is integrally provided with a contact accommodating portion 41 for accommodating the plurality of contacts 2, a mechanism accommodating portion 42 for accommodating the plurality of electric wire connection springs 3, a plurality of lock arms 43 for catching the mating connector, and a protection wall 44 for protecting the lock arms 43. The lock arms 43 are positioned in front of the mechanism accommodating portion 42 on the same side in an upward/downward direction D3, a direction of thickness of the housing 4, as the mechanism accommodating portion 42 and protrude upward with respect to the contact accommodating portion 41.

The contact accommodating portion 41 has a substantially rectangular-parallelepiped outer shape and is configured to be mated with a housing of the mating connector. As shown in FIG. 4, the contact accommodating portion 41 forms an insertion port 411 into which a male contact of the mating connector is inserted and a cavity 412 extending from the insertion port 411 along the frontward/rearward direction D1.

The lock arm 43 supported in a cantilever-like manner at a front end portion of the contact accommodating portion 41 is positioned on an upper face side of the contact accommodating portion 41 as shown in FIGS. 1A, 2, and 4. Since a lock arm is not positioned on a lateral side in the widthwise direction D2 of the housing 4, both faces on the lateral sides in the widthwise direction D2 of the housing 4 are flat, allowing multiple terminal block connectors 1 to be arranged closely arranged side by side in the widthwise direction D2.

A plurality of lock arms 43 arranged side by side in the widthwise direction D2 are positioned on the upper face side of the contact accommodating portion 41 as shown in FIGS. 2 and 4. Each of the plurality of lock arms 43 is easily deflected and a force required for mating the terminal block connector 1 with the mating connector and unmating the terminal block 1 from the mating connector is reduced in comparison with using a single lock arm. Insertion of the connector 1 into the mating connector is therefore eased. Furthermore, since the lock arms 43 are distributed over almost all of the contact accommodating portion 41 in the widthwise direction D2, the mating connector can be caught stably as compared with the case that the lock arm is disposed at only one location. In another embodiment, however, the terminal block connector 1 has only a single lock arm 43.

The lock arm 43, as shown in FIGS. 2 and 4, has a fixed end 431 supported at the front end portion of the contact accommodating portion 41 and a rear end portion 432 as a free end located behind the fixed end 431. A surface 43A of the lock arm 43 has an engagement protrusion 43C for engaging with a portion of the housing of the mating connector. An air gap 43S is formed between a back face 43B of the lock arm 43 and an upper face 41A of the contact accommodating portion 41. The area of a cross section of the air gap 43S gradually increases rearward from the front thereof.

When the housing 4 is inserted into the housing of the mating connector, the lock arms 43 are pushed by the mating connector housing and thus deflected downward, and the engagement protrusions 43C are inserted into engagement holes of the mating connector housing. The mating connector housing is caught by the lock arms 43, so that the terminal block connector 1 and the mating connector are locked in a mating state. Therefore, even in the presence of an external force such as vibration or impact, the terminal block connector 1 and the mating connector remain in the mating state.

Figure 3A:
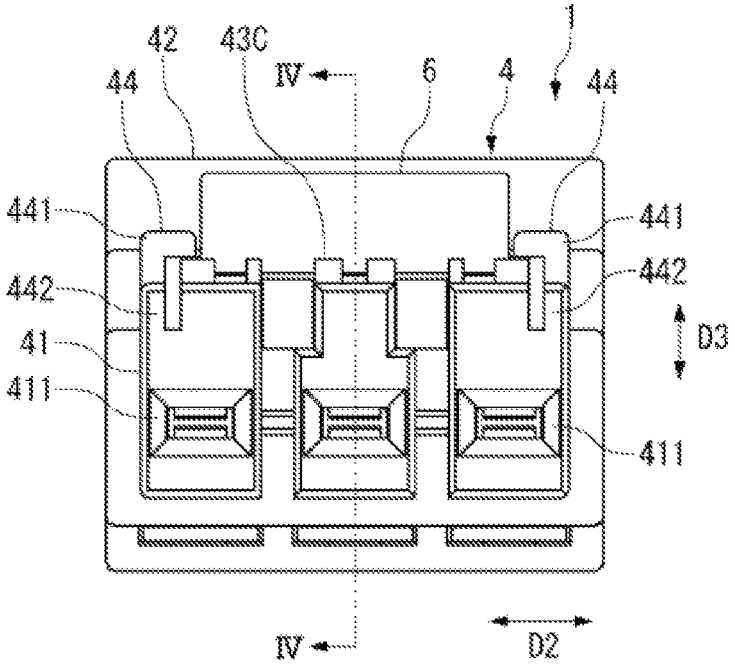
FIG. 3A is a front view of the electrical connector of FIG. 1A.

The protection wall 44 is positioned in the vicinity of the lock arm 43 as shown in FIGS. 1A and 3A. The protection wall 44 has an L-shaped portion 441 located in the vicinity of the rear end portion 432 of the lock arm 43 and a linear portion 442 extending frontward from the L-shaped portion 441. In the shown embodiment, the protection walls 44 protrude upward from both end sides in the widthwise direction D2 of the contact accommodating portion 41.

An upper end portion of each protection wall 44 in the L-shaped portion 441 protrudes inward in the widthwise direction D2 as shown in FIG. 3A. The L-shaped portion 441 is formed in an L shape as viewed from the front of the terminal block connector 1. The L-shaped portion 441 of the protection wall 44 is positioned in the vicinity of the lock arm 43 so as to prevent an excessive load from being applied to the lock arm 43 in a lateral direction during wire connection by the electric wire 7 and/or an operator's finger directly touching the lock arm 43. The L-shaped portion 441 and the linear portion 442 prevent the electric wire 7 from entering the air gap 43S on the back face side of the lock arm 43.

The lock arms 43 are positioned immediately above the contacts 2, respectively, inside the cavity 412 while avoiding the positions of grooves 413 shown in FIGS. 1A and 2 for accommodating inter-position walls of the mating connector housing. A releasing operation knob 6 capable of operating the lock arms 43 collectively is attached to the lock arms 43. In the shown embodiment, all three lock arms 43 are joined to one another with the releasing operation knob 6. When a larger number of lock arms 43 are provided because a larger number of positions are present, the lock arms 43 may be divided into lock arm groups each composed of a proper number of adjacent lock arms 43, and the releasing operation knob 6 may be given to each of the lock arm groups, in order to sufficiently deflect all of the plurality of lock arms 43 pushed collectively.

The rear end portion 432 of each of the three lock arms 43 has an attachment portion 433 shown in FIG. 2 to which the releasing operation knob 6 is attached. The attachment portion 433 has a vertical wall 433A protruding from a surface of the rear end portion 432 and a rectangular plate-like horizontal wall 433B supported at an upper end of the vertical wall 433A and extending perpendicular to the vertical wall 433A.

As shown in FIGS. 2 and 4, the mechanism accommodating portion 42 protrudes upward from the contact accommodating portion 41 in the vicinity of the rear end portion 432 of the lock arm 43. The mechanism accommodating portion 42 forms a mechanism front opening 421 and a tool action opening 422, in addition to an internal space 42S for accommodating the entire electric wire connection spring 3. The tool action opening 422 allows access to the electric wire connection spring 3 from outside of the mechanism accommodating portion 42. The tool action opening 422 penetrates an upper wall 42B of the mechanism accommodating portion 42 in the direction of plate thickness. The mechanism front opening 421 penetrates a front end wall 42A of the mechanism accommodating portion 42 in the plate thickness direction.

The front end wall 42A, as shown in FIGS. 2 and 4, is composed of a vertical portion 42C protruding vertically from the upper face 41A of the contact accommodating portion 41 and an inclination portion 42D extending into an upper end of the vertical portion 42C and inclined with respect to the upward/downward direction. The mechanism front opening 421 is formed in the vertical portion 42C. In other embodiments, the front end wall 42A can be configured to have any other shape provided the internal space 42S has sufficient dimensions for accommodating the electric wire connection spring 3 inside the mechanism accommodating portion 42.

The mechanism front opening 421 is located between the rear end portion 432 of the lock arm 43 and the electric wire connection spring 3 positioned in the internal space 42S in the frontward/rearward direction D1. The mechanism front opening 421 is formed in the front end wall 42A at least over a rearward projected area of the lock arm 43. The motion of a mold part for molding the back face 43B side of the lock arm 43, as described later, or a space distance and a creepage distance required for insulation between the contacts 2 is taken into consideration to define an opening region of the mechanism front opening 421.

Inside the housing 4, the same number of housing chambers 45 as the number of positions are formed over the cavity 412 and the internal space 42S described above. The housing chambers 45 are partitioned with an inter-position wall 4W as shown in FIG. 4. An assembly composed of the contact 2 and the electric wire connection spring 3 is positioned in each housing chamber 45 from an opened rear end portion 4B of the housing 4. The contact 2 is accommodated in the contact accommodating portion 41.

The cover 5, as shown in FIGS. 2 and 3B, is disposed at the rear end portion 4B of the housing 4. The cover 5 is formed from an insulating resin material. The cover 5 has the electric wire insertion portions 51, tool support portions 52 for supporting the tool for wire connection, engagement protrusions 53, 54 shown in FIG. 4 required for attaching the cover 5 to the housing 4, and locating protrusions 55.

The electric wire insertion portion 51 has an opening equivalent to an insertion port of the slot 8. The electric wire insertion portion 51 and the tool support portion 52 are formed in the cover 5 for each position of the connector 1. The tool support portion 52 supports an end portion of the tool for wire connection. When the tool for wire connection is turned frontward using the end portion as a fulcrum, an action protrusion of the tool protrudes from the tool action opening 422 into the internal space 42S and pushes the electric wire connection spring 3 downward. The cover 5 has a depression 56 for receiving an upward-bent end edge 221B of the rear end portion 221A of the contact 2 as shown in FIG. 4.

The cover 5 is attached to the housing 4 by inserting the cover 5 between the upper wall 42B and a lower wall 42G of the mechanism accommodating portion 42 while locating the cover 5 in the housing 4 by inserting the locating protrusion 55 into a recess 42F of the mechanism accommodating portion 42 as shown in FIGS. 2 and 4. At this time, the engagement protrusion 53 is inserted into an engagement hole of the upper wall 42B and the engagement protrusion 54 is inserted into an engagement hole of the lower wall 42G.

Figure 5:
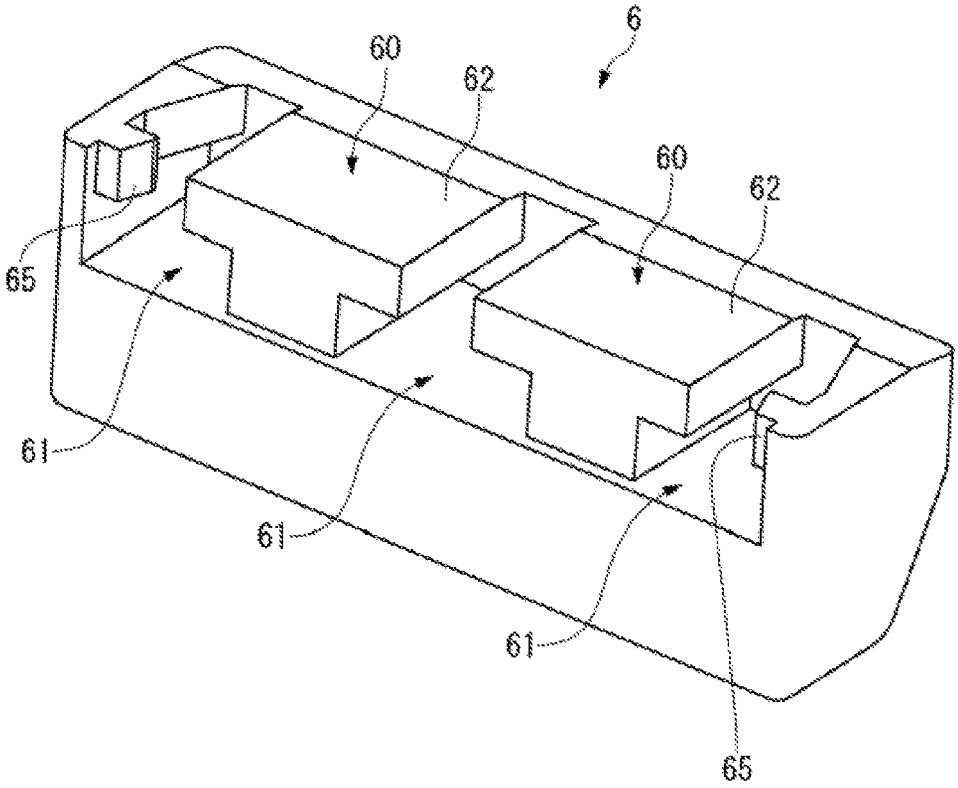
FIG. 5 is a perspective view of a releasing operation knob of the electrical connector.

The releasing operation knob 6, shown in FIGS. 1A and 5, is attached to the rear end portions 432 of the lock arms 43 integrally formed with the housing 4. By the attachment of the releasing operation knob 6, the rear end portions 432 of the lock arms 43 become easier to simultaneously push; it is possible to easily push down the releasing operation knob 6 to deflect the lock arms 43 until the engagement protrusions 43C are disengaged from the engagement holes of the mating connector housing in order to release locking of the mating connector.

The releasing operation knob 6 is detachably attached to the rear end portions 432 of the lock arms 43. A plurality of releasing operation knobs 6 may be produced with different sizes, such as different heights. The releasing operation knobs 6 are thus interchangeable; a knob 6 with a large size could be used to improve an operation or a knob 6 having a low height could be used according to a height limitation of a device in which the terminal block connection 1 is disposed. Since the releasing operation knob 6 is separate from the lock arms 43, the releasing operation knob 6 can also be formed from a metal material.

As shown in FIG. 5, engagement protrusions 60 and engagement portions 65 for engaging with the attachment portion 433 of the lock arm 43 shown in FIG. 2 are formed on a bottom side and a rear side of the releasing operation knob 6. The plurality of engagement protrusions 60 protrude from a bottom side of the releasing operation knob 6. Recesses 61 for receiving the horizontal walls 433B of the attachment portions 433 are disposed between two engagement protrusions 60, 60 and outside the engagement protrusions 60, 60. The engagement portion 65 engages with the attachment portion 433, thereby preventing the releasing operation knob 6 from disengaging from the attachment portion 433.

By positioning the releasing operation knob 6 in front of the attachment portions 433, and sliding the releasing operation knob 6 rearward while supporting the back faces 43B of the lock arms 43 with a jig, the attachment portions 433 and the engagement protrusions 60 engage with each other, and the engagement portions 65 engage with the vertical walls 433A of the attachment portions 433 located at both end sides in the widthwise direction D2. In this manner, the releasing operation knob 6 is connected to the lock arms 43.

The use of the terminal block connector 1 will be now be described in greater detail.

The contacts 2 and/or the core wire 71 generates heat with electrical resistance at a location of contact between the contact 2 and the core wire 71 of the electric wire end 7A, the contact portion 21A of the contact 2, or the like. Since the second end portion 32 is in contact with the contact 2 and the lower edge 301 of the window 30 is in contact with the core wire 71 immediately near the location of contact between the contact 2 and the core wire 71 coming into contact with each other, heat is easily transmitted from the contact 2 and/or the core wire 71 to the electric wire connection spring 3. Through the mechanism front opening 421 located in the vicinity of the electric wire connection spring 3, the heat of the electric wire connection spring transmitted from the contact 2 and/or the core wire 71 can be sufficiently released into external air through the mechanism front opening 421. Therefore, it is possible to allow large currents to flow while avoiding overheating of the electric wire 7 and/or the housing 4.

The housing 4 and the cover 5 have a plurality of openings, including the tool action openings 422 and holes opened in the tool support portions 52 of the cover 5, in addition to the mechanism front openings 421. Therefore, air entering the housing chamber 45 through some of these openings exits through another opening, and the housing chamber 45 is thus ventilated. It is therefore possible to avoid heat accumulation inside the housing chamber 45.

The mechanism front opening 421 is located between the rear end portion 432 of the lock arm 43 and the electric wire connection spring 3 positioned in the internal space 42S in the frontward/rearward direction D1. Therefore, a route from the internal space 42S to the air gap 43S through the mechanism front opening 421 extends along the frontward/rearward direction D1. The rearward projected area of the lock arm 43, including the attachment portion 433, is within the opening region of the mechanism front opening 421. Accordingly, a mold part for molding a portion from the back face 43B side of the lock arm 43 to the bottom side and rear side of the attachment portion 433 can pass through the mechanism front opening 421. The mold part can therefore move along the frontward/rearward direction D1 so that it is possible to mold the back face 43B side of the lock arm 43.

The protection wall 44 is molded from a mold part different from the mold part for molding the back face 43B side of the lock arm 43. A protection wall 44 having a suitable size can be positioned in the vicinity of the lock arm 43 according to usage of the terminal block connector 1 and/or the degree of necessity of damage prevention.

The mechanism front opening 421 also makes it possible to give a lock function to the terminal block connector 1 while avoiding an increase in the thickness of the housing 4. Because the mechanism front opening 421 is formed in the front end wall 42A of the mechanism accommodating portion 42, the lock arms 43 integral with the housing 4 do not interfere with a mold part for molding a peripheral portion thereof. The lock arm 43 and the protection wall 44 can be integrally molded with the housing 4 on the same side as the mechanism accommodating portion 42 in the thickness direction of the housing 4 and in a space in front of the mechanism accommodating portion 42. It is therefore possible to avoid an increase in the thickness of the terminal block connector 1 even with the mechanism accommodating portion 42 protruding.

The mechanism front opening 421 thus makes it possible to provide the terminal block connector 1 with the lock function while avoiding an increase in the thickness of the housing 4, and can also contribute to heat release. Even when the height of the lock arm 43 is limited by the opening area of the mechanism front opening 421, such a limitation can be overcome by attachment of the releasing operation knob 6.

What is claimed is:

1. An electrical connector, comprising:

a contact;

an electric wire connection spring connecting an electric wire to the contact; and a housing including a contact accommodating portion receiving the contact, a mechanism accommodating portion receiving the electric wire connection spring, and a lock arm supported on the contact accommodating portion in front of the mechanism accommodating portion and configured to catch a mating connector, the mechanism accommodating portion has a front opening formed in a front end wall of the mechanism accommodating portion over at least an uppermost rearward projection of a rear end portion of the lock arm along an attachment portion rectangular plate-like horizontal wall disposed between the rear end portion of the lock arm and the electric wire connection spring.

2. The electrical connector of claim 1, wherein the electric wire connection spring applies a pressure to the electric wire toward the contact and retaining the electric wire.

3. The electrical connector of claim 1, wherein the mechanism accommodating portion has a tool action opening extending through an upper wall of the mechanism accommodating portion.

4. The electrical connector of claim 1, wherein the housing has a protection wall disposed in a vicinity of the lock arm.

5. The electrical connector of claim 4, wherein the protection wall is formed integrally with the lock arm in a single piece.

6. The electrical connector of claim 4, wherein the contact accommodating portion, the mechanism accommodating portion, the lock arm, and the protection wall are formed integrally in a single piece.

7. The electrical connector of claim 1, further comprising a releasing operation knob configured to be pushed to deflect the lock arm and release the mating connector from the lock arm.

8. The electrical connector of claim 7, wherein the releasing operation knob is removably attached to the lock arm.

9. The electrical connector of claim 1, wherein the contact has a pair of contact arms disposed in the contact accommodating portion and a proximal portion with an upper wall disposed in the mechanism accommodating portion.

10. The electrical connector of claim 9, wherein the electric wire connection spring is positioned on a surface of the upper wall of the proximal portion of the contact.

11. The electrical connector of claim 10, wherein the electric wire connection spring has a window receiving the electric wire in a deformed position of the electric wire connection spring.

12. The electrical connector of claim 11, wherein a rear end portion of the upper wall of the contact and a second end portion of the electric wire connection spring are disposed in the window.

13. The electrical connector of claim 9, wherein the proximal portion of the contact has a lower wall with an upright rear end portion extending perpendicular to the upper wall and the lower wall.

14. The electrical connector of claim 13, wherein a slot disposed in the housing is defined by the upper wall, the upright rear end portion of the lower wall, and a lower wall of the housing.

15. The electrical connector of claim 14, wherein an end of the electric wire is received in the slot and abuts against the upright rear end portion of the lower wall in the slot.

16. The electrical connector of claim 1, further comprising a cover disposed at a rear end portion of the housing, the electric wire extending through an electric wire insertion portion of the cover.

17. The electrical connector of claim 16, wherein the cover has a plurality of engagement protrusions releasably engaging with the rear end portion of the housing and a tool support portion extending through the cover.

* * * * *